US005141051A

United States Patent [19]

Lenhart

[11] Patent Number: 5,141,051

[45] Date of Patent: Aug. 25, 1992

[54] ELECTRICAL WET CONNECT AND CHECK VALVE FOR A DRILL STRING

[75] Inventor: Robert A. Lenhart, Cypress, Tex.

[73] Assignee: Ensco Technology Company, Houston, Tex.

[21] Appl. No.: 831,708

[22] Filed: Feb. 5, 1992

Related U.S. Application Data

[63] Continuation-in-part of Ser. No. 710,621, Jun. 5, 1991.

[51] Int. Cl.[5] ..... E21B 23/00

[52] U.S. Cl. ..... 166/65.1; 439/190

[58] Field of Search ..... 166/65.1, 66, 77, 250, 166/317, 325; 175/40, 45; 439/190, 191, 27, 1332, 567, 581

[56] References Cited

U.S. PATENT DOCUMENTS 4,767,349 8/1988 Pottier et al. ..... 166/65.1 X
4,921,438 5/1990 Godfrey et al. ..... 439/190
5,058,683 10/1991 Godfrey et al. ..... 166/65.1 X

*Primary Examiner*—Thuy M. Bui
*Attorney, Agent, or Firm*—Fulbright & Jaworski

[57] ABSTRACT

A connectable and releasable wet connect for transmitting electrical signals in a well drill string includes retrievable coacting telescoping male and female electrical connectors. A check valve allows downward passage of fluid through the drill string but prevents the upward flow of fluid. A check valve includes a valve seat surrounding the male member having shoulders for holding the seat in a drill string and sealing with a drill string. The check valve includes a valve element slidably and sealingly engaging the male member and sealingly engagable with the valve seat for blocking upward flow through the drill string.

7 Claims, 3 Drawing Sheets

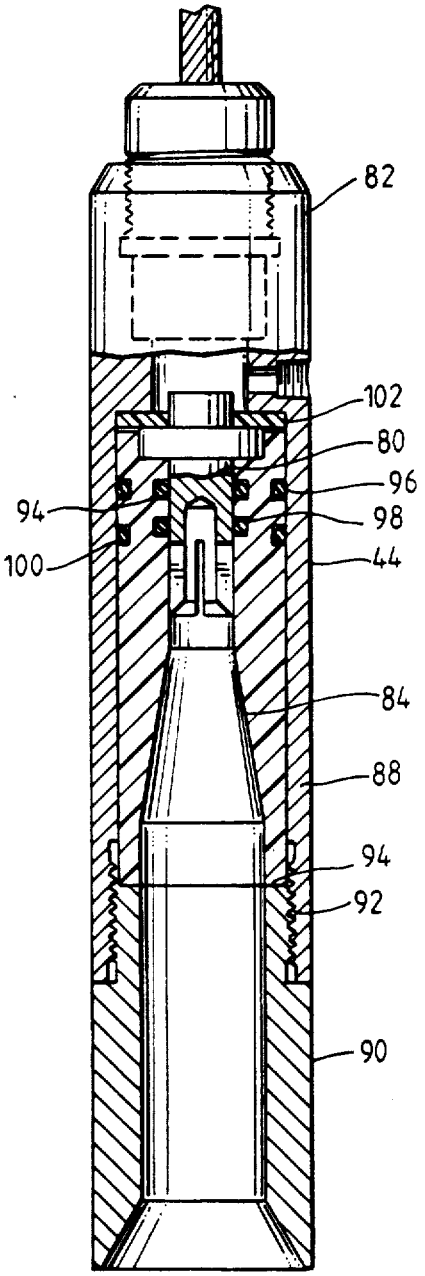
FIG.4
FIG.5
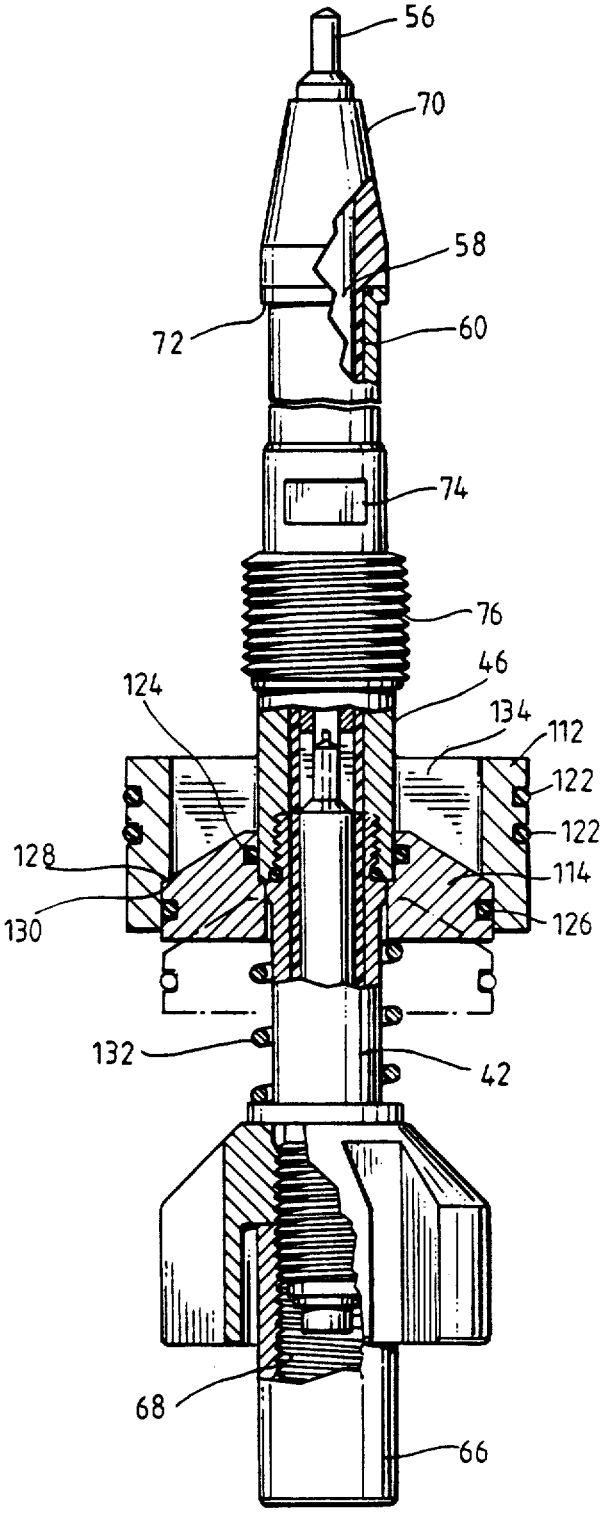

ELECTRICAL WET CONNECT AND CHECK VALVE FOR A DRILL STRING

CROSS-REFERENCE TO RELATED APPLICATION

This application is a continuation in part of application Ser. No. 07/710,621, filed Jun. 5, 1991 entitled "Releasable Electrical Wet Connect for a Drill String".

BACKGROUND OF THE INVENTION

Drilling directional and/or horizontal wells requires the use of a survey tool, referred to as a steering tool, to monitor the well bore path and monitor the orientation of the drilling assembly. One method of transmitting the survey information required to measure the orientation of the drill bit and the well bore path is by the use of an electrical connector connected between the steering tool and the well surface for conducting signals. Horizontal or high angle well bores, unlike conventional vertical well bores, are used to drill long well bore intervals in the target pay zone. As a result, many horizontal wells are drilled live (producing oil/gas) which requires the use of blowout control equipment at the well surface and around the outside of the drill string. This requires that the electrical conductor conducting signals from a steering tool to the well surface be inside the drill string. Such methods are disclosed in co-pending patent applications Ser. No. 07/710,621 filed Jun. 5, 1991 and patent application Ser. No. 07/665,877 filed Mar. 7, 1991.

However, the well producing formation may be under pressured, that is, having pore pressure below geostatic pressure. In these cases, the well is required to be drilled with a fluid that will not damage the well formation, such as an inert oil base mud system or an aerated mud system. Aerated drilling fluids are air/gas systems used to carry cuttings to the surface. However, aerated mud and air/gas drilling presents a unique operations problem as back flow up the drilling string must be prevented. That is, when releasing the drilling fluid and connecting a pipe joint into the drilling string, back flow could cause cuttings to be carried into the drill string and result in plugging. While a float or check valve may be conventionally used on the bottom end of the drill string, the entire drill string must be blown down and repressurized after adding each additional pipe joint into the drill string, all of which will effect the drilling time, expense and efficiency. Therefore, intermediate check valves would be desirable in the drill string at various levels. However, with the use of an electrical conductor through the inside of the drill string intermediate floats or check valves have not been used.

In order to provide a solution to the above problem, the present invention provides a connectable and releasable wet connect which telescopically connects and disconnects an electrical conductor in the drilling string as required. When connected, the wet connect electrically isolates the transmitted power and/or signal from electrical ground and the drilling fluid. This allows free electrical communication between the downhole steering tool and the surface support/monitoring equipment. In addition to electrically connecting the power and/or signal, the present wet connect includes a check valve to prevent undesired backflow of drilling fluid up the drill string which could occur during various times during the drilling operation, but allows the downward flow of drilling fluid. Backflow usually occurs as a result of the annuals having a higher pressure than the fluid in the drill string. While this is common during live or unbalanced drilling, this backflow is prevented by the present invention.

SUMMARY

The present invention is directed to a connectable and releasable wet connect and check valve for transmitting electrical signals and drill fluid in a well drill string. The wet connect includes coating telescoping male and female electrical connector members. The male member includes a support shoulder for supporting the wet connect from a shoulder in the drill string, a passageway for the flow of fluids through the drill string, and an upstanding electrical contact extending through the male member for connection to and support of an electrical conductor. A check valve is provided for allowing the downward passage of fluid flow through the drill string but preventing the upward flow of fluid through the drill string. The check valve includes a valve seat surrounding the male member in which the valve seat has a lower shoulder and an upper shoulder for holding the seat in a drill string and the seat includes sealing means for sealing with a drill string. A valve element slidably and sealingly engages the male member and is sealingly engagable with the valve seat for blocking upward flow through the drill string. The female member includes a telescopically engagable and releasable electrical receptable for coacting with the electrical contact and an insulating female seal positioned below the electrical receptacle for coacting with the male member for electrically isolating the receptacle in contact from fluid in the drill string when they are engaged.

Yet a further object of the present invention is the provision of spring means between the male member and the valve element yieldably urging the element against the valve seat for insuring quick closure of the check valve.

Another further object of the present invention is the provision of a connection between the valve seat and the male member for holding the male member against movement by downhole pressure.

Still a further object of the present invention is wherein the sealing means sealing between the seat and the drill string includes resilient seal means. Preferably the valve element sealingly engages the male member and the valve seal with resilient seal means and metal-to-metal seals.

Still a further object of the present invention is the provision of a drill string sub having a first upwardly facing shoulder for receiving the support shoulder of the male member and a second upwardly facing shoulder for receiving the lower shoulder of the valve seat. Preferably the second shoulder is positioned above the first shoulder and has a larger circumference than the circumference of the first shoulder.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIG. 4 is an enlarged, elevational view, in cross-section of the female member of the wet connect of FIG. 2, and FIG. 5 is an enlarged, elevational view, in cross-section, of the male member of the connector of FIG. 2.

BRIEF DESCRIPTION OF THE PREFERRED EMBODIMENTS

The present invention of the wet connect and check valve for transmitting electrical signals in a well drill string and controlling fluid flow therethrough will be described in connection with its use in monitoring a steering tool and directional drilling applications for purposes of illustration only. And in particular, the invention described herein is useful in the method of operation disclosed in patent application Ser. No. 07/665,877, filed Mar. 7, 1991, which is incorporated herein by reference. However, it is to be understood that the present wet connect and check valve can be used to conduct other types of electrical signal and power and fluid through drill pipes in other applications.

Figure 1C:
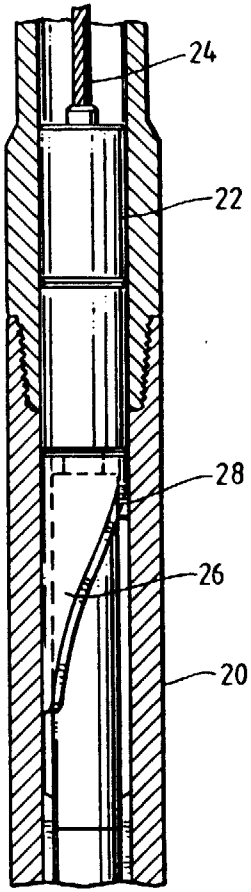
FIG. 1C is a continuation of FIG. 1B.
Figure 1B:
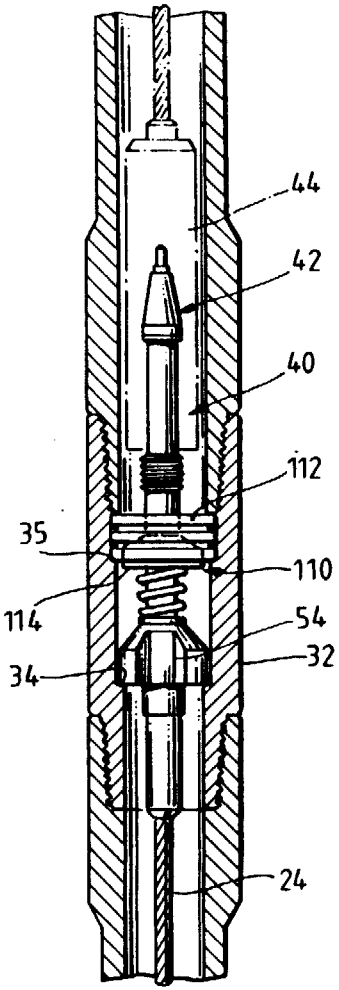
FIG. 1B is an enlarged, fragmentary, elevational view, partly in cross-section, a portion of the drilling string of FIG. 1A.
Figure 1A:
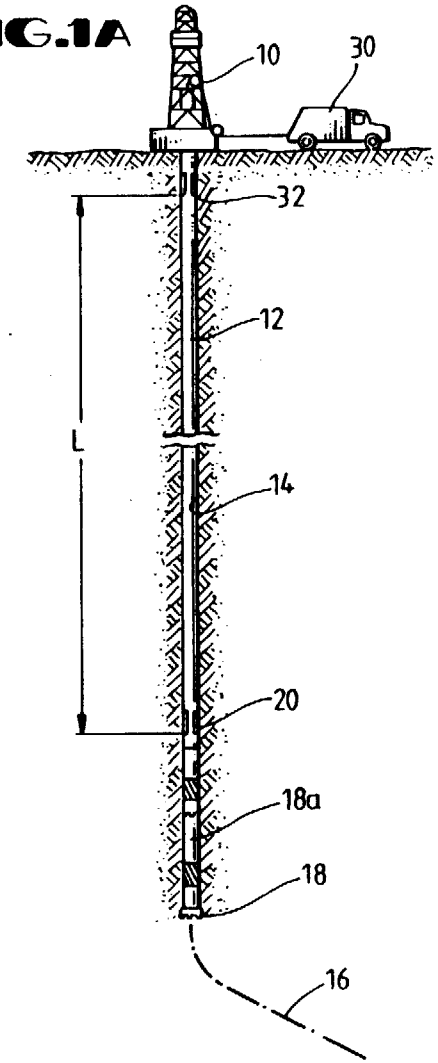
FIG. 1A is a schematic, elevational view, illustrating the beginning of drilling a directional and/or horizontal well.

Referring now to the drawings, and particularly to FIG. 1A, a drill rig 10 is shown for operating a drill string 12 for drilling a well bore 14. As shown, the well bore 14 is generally vertical, but as indicated by the broken line 16, the further direction of the drill string 12 is nonvertical, and may be horizontal. As shown in FIG. 1A, the drilling bit 18 is just above the location where the oriented/steerable drilling is to start. In order to drill a directional path 16, a conventional downhole fluid drive motor or steerable motor 18*a* or a conventional directional drilling string includes a drill bit 18 and is actuated by the flow of fluid down the inside of the drill string 12. The axis of the bit 18 is offset from the axis of the well bore 14. The offset drill bit 18 can also be used for drilling a straight bore 14 by continuously rotating the drill string 12 until the directional correction is required. At that time, rotation of the drill string 12 is then stopped, the steerable fluid motor 18*a* is oriented in the required direction, and the drilling continues along the path 16 by fluid actuation of the motor 18*a* driving the bit 18. One suitable downhole motor is offered by Trudril. In order to drill an oriented hole, the drill string 12 includes an orienting sub 20 (FIGS. 1A and 1C) which is rotatably aligned with the steerable drilling motor 18*a*. A conventional wireline steering tool 22 (FIG. 1C) such as offered by Tensor, is lowered on an electrical conductor 24 and seated in the orienting sub 20. Conventionally, a muleshoe 26 is used which is connected to tool 22 and orients the tool 22 relative to a key 28. The muleshoe 26 may be either a latching or a nonlatching type. Thus the muleshoe 26 orients the steering tool 22 relative to the steerable motor 18*a*. The above described apparatus and method is generally conventional.

A cable head landing sub 32 (FIGS. 1A and 1B) having a shoulder 34 and a shoulder 35 may be included in the drill string 12. In order to transmit electrical signals between the steering tool 22 and the measurement unit 30, one or more connectable and releasable electric wet connects generally indicated by the reference numeral 40, consisting of a male member 42 and a female member 44 (FIGS. 1B, 3 and 4) are utilized.

The male member 42 (FIGS. 1B, 2 and 5) includes a body 46 and a support shoulder 48, which may be formed by a plurality, such as three downwardly and outwardly directed fluted support legs 50, for seating on a shoulder, such as shoulder 34, in the drill string 12, for supporting the cable 24, which has a length L, for example, 6000 feet and also supports the steering tool 22 during running. Preferably, the fluted legs 50 are attached to the body 46 by a threaded connection 52. A passageway 54, such as the openings between the legs 50, allow circulation of well fluids through the drill pipe 12.

The male member 42 includes an upwardly directed, preferably tapered on the top, electric contact 56 which extends by a rod 58 through insulator 60, which is made of an insulating material, such as Ultem, and is used to centralize and seal the electrical rod 58. The body 46 is preferably metal. A lower rope socket connector 66, which may be made from high strength steel, includes internal threads 68 for accepting a conventional rope socket electrically connected to the electrical conductor 24 for electrically and mechanically attaching a length of conventional single or multiple conductor wireline.

The male member 42 includes a tapered and insulating seal 70 which is positioned below the electrical contact 56 and may be made of any suitable insulating material, such as Ultem. The tapered seal 70 coacts with a coating seal in the female member 44 which will be described more fully hereinafter.

The male member 42 may also include fishing shoulder 72 which allows a standard collet type fishing overshot to be used to latch on to the male member 42 to retrieve it from the drill string 12 along with any attached conductor cable 24 and/or steering tool 22.

In addition, the male member 42 may include a centralizing ring 74, which may be fluted, and is used to centralize the lower end of the female member 44 to minimize vibration, misalignment, and insure good electrical contact and sealing between the male and female members 42 and 44. In addition, the male member 42 may also include a threaded section 76 which is used to attach to a surface overshot to facilitate surface handling, as this provides an easier structure for handling than the fishing shoulder 72 when at the well surface.

Referring now to the female member electrical connector 44 (FIGS. 1, 2, 3, 4), it includes an electrical receptacle 80 which may be constructed out of an electrical conducting material, such as stainless steel. The receptacle 80 makes a telescopically engagable and releasable engagement with the electrical contact 56 of the male member 42. Preferably, the lower portion of the electrical connector 80 includes a split skirt design creating a spring action to insure good electrical contact with the contact 56. The female member 44 may be run into the drill string 12 on conventional single or multiconductor wireline having at least one electrical conducting strand surrounded by multistrand of wire for protection and strength. The member 44 includes a connector 82 for receiving a conventional rope socket, such as a titan head, which may include a weight bar, if necessary, to assist in the engagement of the male member 42 and female 44. The connection 82 makes an electrical connection between the attached wireline conductor and the electrical receptacle 80.

The female member 44 includes a tapered and insulating female seal 84 having a tapered surface such as surface for coacting with the tapered insulating seal 70 of the male member 46. The coacting seals 84 and 70 coact to create an electrical seal isolating the mated electrical contact 56 and receptacle 80 from shorting to ground either through drilling fluid or metal components. Preferably, dielectric grease may be applied inside of the seal 84 to assist in sealing. In order to insure and maintain a secure seal, the seals 84 and 70 must be maintained in engagement in spite of drilling vibration or movement therethrough of drilling fluids, therefore, there is structural alignment and support for maintaining the seals 70 and 84 in engagement. The female member 44 includes an outer metal jacket 88 which provides a backup support for the seal 84 and is preferably of a high strength steel or stainless steel. In addition, a lower jacket 90 is threadably secured by threads 92 to the outer jacket 88 and includes a shoulder 94 for abutting, supporting, and applying compression to the seal 84. Because of this, the seal 84 is securely held in place inside the outer jacket 88. In addition, the lower jacket 90 coacts with the centeralizing ring 74 on the male member 42 to centralize the lower end of the female member 44 to minimize vibration, misalignment and insure good electrical contacting and sealing between the members 42 and 44.

Well fluids are sealed out of the upper end of the female member 44 by the use of interior O-ring seals 94 and exterior O-ring seals 96, and if desired as a backup, additional interior O-ring 98 and exterior O-ring 100. In addition, a compression washer 102 is provided between the electrical receptacle 80 and the interior of the outer jacket 88. It is to be noted that there is a slight space between the upper end of the seal 84 and the washer 102. However, when the lower jacket 90 is threadably tightened in the outer jacket 88 and applies a compressive force on the tapered seal 88, the compression washer 102 is also placed in compression and so acts as a backup seal for the O-rings 94, 96, 98 and 100.

Figure 2:
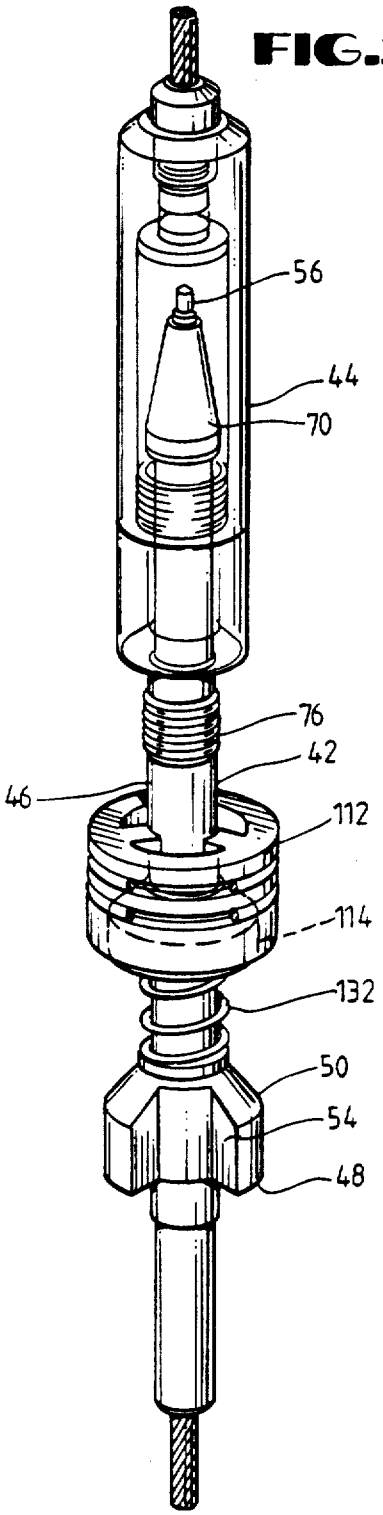
FIG. 2 is an enlarged perspective elevational view of the wet connect of the present invention.

It is noted in FIG. 2 that the downwardly and outwardly fixed legs 50 are preferably rigid for supporting the electrical cable 27 and the steering tool 22 from a coacting shoulder in the drill string 12, such as shoulder 34. The outside diameter of the legs 50 are sized to allow it to pass through the drill string, both downwardly for seating, and upwardly for retrieval from the drill string 12. As described in the above mentioned patent applications, the male connector is designed to be able to be used as either a primary connector or an intermediate connector.

In operation, the well bore 14 is conventionally drilled by the drill string 12 such as by rotating the drill pipe 12 down during the vertical portion 14 of the well. However, when the drilling bit 18 is just above the location where the oriented drilling is to start along a directional path 16, the bit 18 must be oriented. The wireline steering tool 22 is lowered on the electrical conductor 24 into the muleshoe 26 and the male member 42 of the wet connect 40 may be landed on the shoulder 34 of the cable head landing sub 32. A conventional check valve (not shown) may be connected to the lower end of the drill string 12 adjacent the top of the motor 18*a*. However, in the prior art, it was not feasible to locate any check valves in the drill string 12 above the orienting sub 20 because of the electrical conductor 24. Therefore, as the drilling progressed, and each time an additional joint of drill pipe was required to be inserted into the drill string 12, the entire drill string 12 was opened thereby releasing the pressurized aerated drill fluid. And each time that the drilling fluid was again pressurized required a considerable amount of time which increased the expense and slowed down the drilling progress. For example only, in depressurizing and repressurizing 6,000 feet of drill string 12, the time required may be 60 minutes. In order to overcome this time and expense, the present invention provides intermediate check valves between the orienting sub 20 and the well surface which may be operable for allowing the downward passage of fluid flow through the drill string 12 but preventing the upward flow of fluid through the drill string 12 even in the presence of the electrical cable 12 of the wet connect 40.

Referring now to FIGS. 1B, 2, 3 and 5, the connectable and releasable electric wet connect 40 includes a check valve seat 112 and a valve element 114. The valve seat 112 surrounds the male member and includes a lower shoulder 116 which is adapted to seat on shoulder 35 of the cable head landing sub 32 and includes an upward shoulder 118 for engagement by a downwardly directed shoulder 120 such as a pin joint in the drill string 12. Thus, the valve seat is securely held in place and the drill sting 12 aginst movement in either an upwardly or downwardly direction. The valve seat 112 also includes seal means 122 such as O-rings for sealing in the drill string 12 such as in the landing sub 32.

Figure 3:
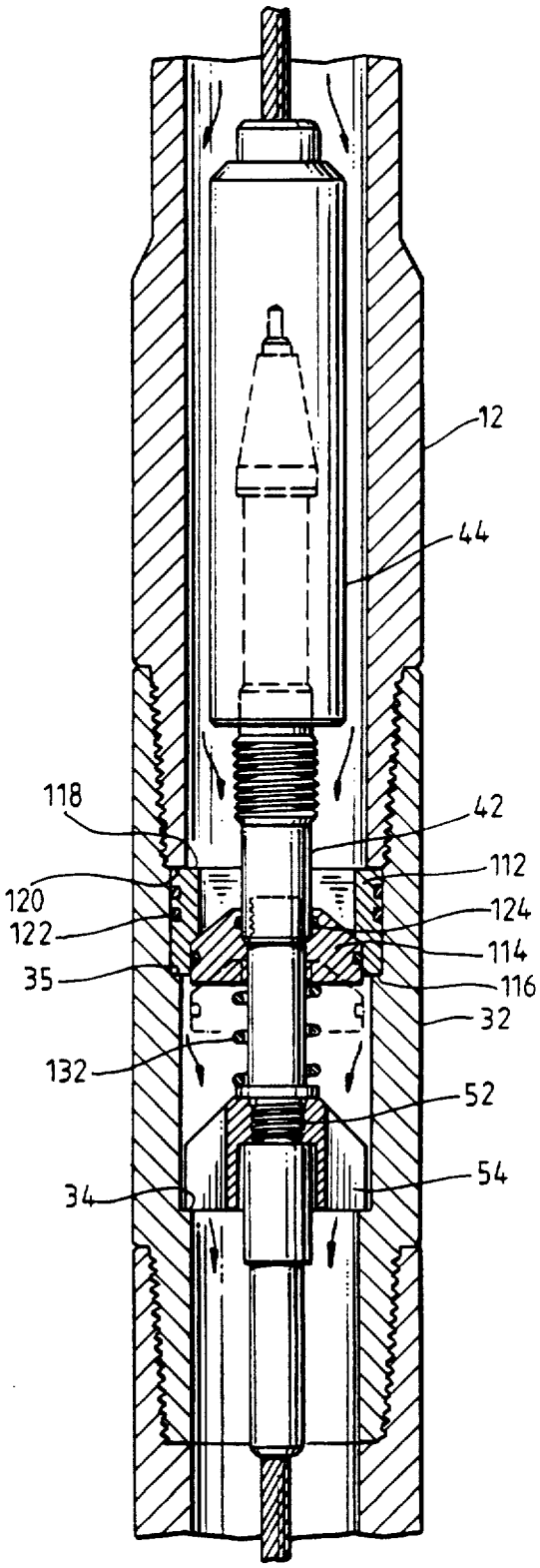
FIG. 3 is an enlarged elevational view of the wet connect of FIG. 2 in a drill string.

The valve element 114 is slidably and sealably engagable with the male member 42 and is sealingly engagable with the seat 112 for blocking upward flow through the drill string 12 but allowing downward flow through the drill string 12 as indicated by the arrows in FIG. 3. The valve element 114 is telescopically movable on the male member 42 and is sealably engagable therewith such as by seal means 124. The valve element 114 sealingly engages the valve seat 112 preferably both with resilient sealing means 126 and with a metal-to-metal seal shoulders 128 and 130, respectively, on the valve element 114 and the valve seat 112. Preferably, spring means 132 is provided on the male member 42 yieldably acting against the valve element 114 to seat it on the valve seat 112. Preferably, a connection is provided between the valve seat 112 and the male member 42 such as a plurality or ribs 134 which, while allowing the passage of fluid through the valve seat 112, insures the coaxial positioning of the valve element 114 with the valve seat 112.

Since the check valve 110 is not retrievable from the drill string 12, the check valve, along with the wet connect 40, is placed in the drill string 10 along with the landing sub 32. However, the female member 44 is still releasable and connectable from the male member 42 as additional joints of pipe are added to the drill string 12 as drilling continues. However, when these additional joints of pipe are added above the sub 32, the check valve 110 holds the pressure in the string 12 between the sub 32 and the bottom of the drill string 12 and prevents blowdown of the pressure or any back pressure from the drilled formation.

As has been indicated in co-pending patent application Ser. No. 07/710,621, after the bore hole 14 has been drilled to a depth that makes tripping the wet connector female member 44 uneconomical, a long segment of wire which has a female member 44 on a bottom end and an intermediate male member 42 on the other end is run into the drill string 12 with the female member seated on the male member 42 while the intermediate male member is spaced out to seat in a tool joint or intermediated support sub containing an additional check valve. Thus, one or more of the check valves may be installed in the drill string 12 as drilling continues.

The present invention, therefore, is well adapted to carry out the objects adapted and attain the ends and advantages mentioned as well as other inherent therein. While a presently preferred embodiment of the invention has been given for the purpose of disclosure, numerous changes in the details of construction, and arrangements of parts, will be readily apparent to those skilled in the art and which are encompassed within the spirit of the invention and the scope of the appended claims.

What is claimed is:

1. A connectable and releasable wet connect and check valve for transmitting electrical signals and drill fluid in a well drill string comprising, coacting telescoping male and female electrical connector members, said male member including, a support shoulder for supporting the wet connect from a shoulder in the drill string, a passageway for the flow of fluids through the drill string, an upstanding electrical contact extending through the male member for connection to and support of an electrical conductor, a check valve for allowing the downward passage of fluid through the drill string but preventing the upward flow of fluid throught the drill string including, a valve seat surrounding the male member, said valve seat having a lower shoulder and an upper shoulder for holding the seat in a drill string, said seat including sealing means for sealing with a drill string, a valve element slidably and sealing engaging the male member and sealingly engagable with the valve seat for blocking upward fluid flow through the drill string, said female member including, a telescopically engagable and releasable electrical receptacle for coacting with the electrical contact, an insulating female seal positioned below the electrical receptacle for coacting with the male member for electrically insulating the receptacle and contact from fluid in the drill string when they are engaged.

2. The apparatus of claim 1 including, spring means between the male member and the valve element yielding urging the element against the valve seat.

3. The apparatus of claim 1 including, a connection between the valve seat and the male member for holding the male member against downhole pressure.

4. The apparatus of claim 1 wherein the sealing means sealing between the seat and the drill string includes resilient seal means.

5. The apparatus of claim 1 wherein the valve element sealing engages the male member and the valve seal with resilient seal means.

6. The apparatus of claim 1 including, a drill string sub having a first upwardly facing shoulder for receiving the support shoulder of the male member, a second upwardly facing shoulder for receiving the lower shoulder of the valve seat.

7. The apparatus of claim 6 wherein the second shoulder is positioned above the first shoulder and has a larger circumference that the circumference of the first shoulder.

* * * * *